United States Patent [19]

Eaton et al.

[11] Patent Number: 4,610,698

[45] Date of Patent: Sep. 9, 1986

[54] ABRASIVE SURFACE COATING PROCESS FOR SUPERALLOYS

[75] Inventors: Harry E. Eaton, Woodstock; Richard C. Novak, Glastonbury; Alfred P. Matarese, North Haven, all of Conn.

[73] Assignee: United Technologies Corporation, Hartford, Conn.

[21] Appl. No.: 624,446

[22] Filed: Jun. 25, 1984

[51] Int. Cl.[4] ..... B24D 11/02

[52] U.S. Cl. ..... 51/295; 51/293; 51/309

[58] Field of Search ..... 51/293, 295, 309; 428/621

[56] References Cited

U.S. PATENT DOCUMENTS

| | | | |
|---|---|---|---|
| 3,248,189 | 4/1966 | Harris, Jr. | 51/295 |
| 3,377,264 | 4/1968 | Duke et al. | 204/290 |
| 3,508,890 | 4/1970 | Fontanella | 51/295 |
| 3,615,309 | 10/1971 | Dawson | 51/309 |
| 3,779,726 | 12/1973 | Fisk et al. | 51/295 |
| 3,871,840 | 3/1975 | Wilder et al. | 51/295 |
| 3,920,410 | 11/1975 | Kunda et al. | 29/192 R |
| 3,975,165 | 8/1976 | Elbert et al. | 29/182.2 |
| 4,029,852 | 6/1977 | Palena | 428/621 |
| 4,249,913 | 2/1981 | Johnson et al. | 51/295 |
| 4,269,903 | 5/1981 | Clingman et al. | 428/591 |
| 4,291,089 | 9/1981 | Adamovic | 428/325 |
| 4,374,173 | 2/1983 | Adamovic | 428/325 |
| 4,386,112 | 5/1983 | Eaton et al. | 427/34 |

*Primary Examiner*—Paul Lieberman
*Assistant Examiner*—Willie J. Thompson

[57] ABSTRACT

A combination of sintering, plasma arc spraying, hot isostatic pressing and chemical milling is used to form an abrasive surface on an article. Alumina coated silicon carbide particulates are clad with nickel and sinter bonded to the surface of a superalloy turbine blade tip. An impermeable layer of plasma arc sprayed superalloy matrix is deposited over the particulates and then has its inherent voids eliminated by hot isostatic pressing. The abrasive material so formed on the surface is then machined to expose the particulates. Next, a portion of the matrix is removed so that the machined particulates project into space and are thus best enabled to interact with abradable ceramic air seals in a gas turbine engine. The ceramic particulates are sized so they are larger than the finished thickness of the abrasive and they have small aspect ratios. Thus, a high density spacing can be achieved while at the same time it is insured that matrix adequately surrounds the particles and holds them in place during use.

15 Claims, 10 Drawing Figures

FIG. 1
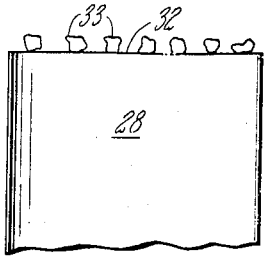
FIG. 2
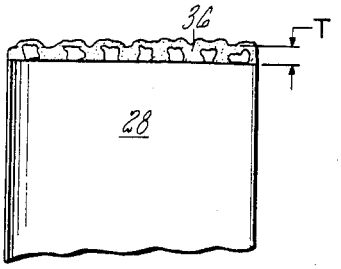
FIG. 3
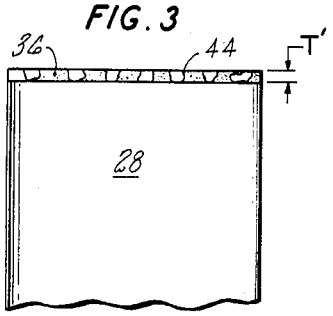
FIG. 4
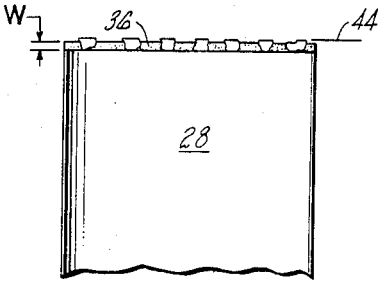
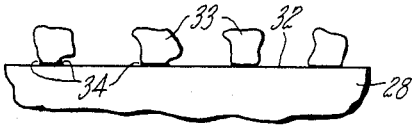
FIG. 5
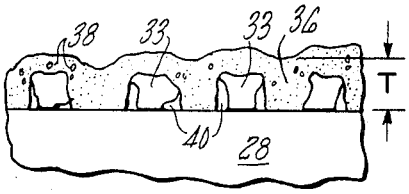
FIG. 6
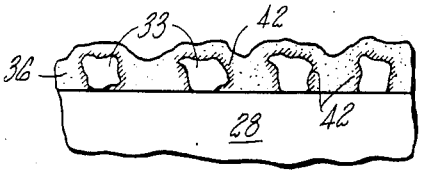
FIG. 7

FIG. 8
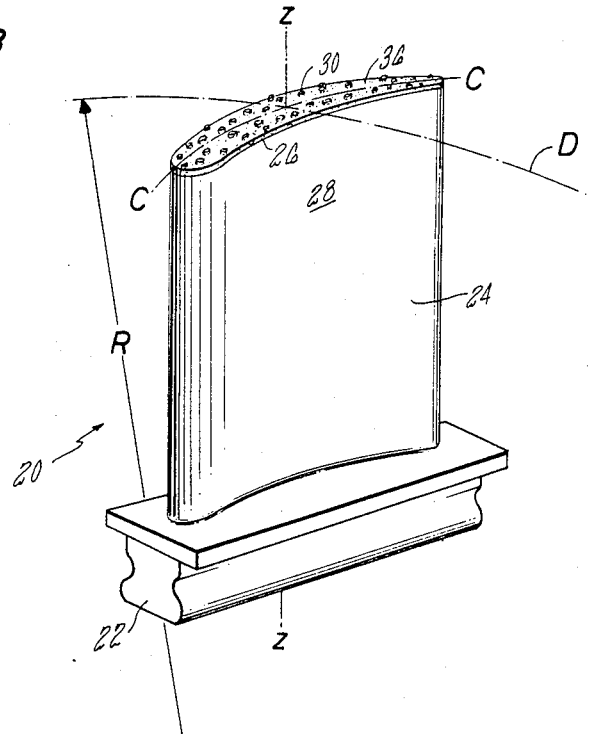
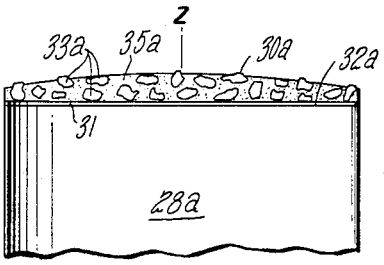
FIG. 9 PRIOR ART
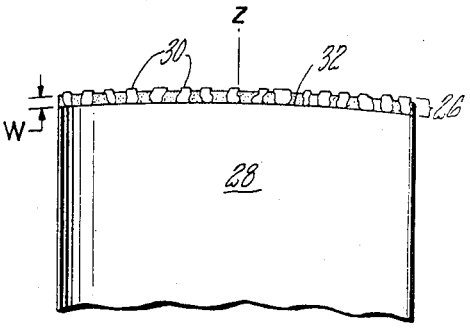
FIG. 10

ABRASIVE SURFACE COATING PROCESS FOR SUPERALLOYS

TECHNICAL FIELD

The present invention relates to a method of forming a particulate containing high temperature abrasive on a substrate, particularly to a process which involves metal spraying.

BACKGROUND

Gas turbine engines and other axial flow turbomachines have rows of rotating blades contained within a generally cylindrical case. It is very desirable to minimize the leakage of the gas or other working fluid around the tips of the blades where they come close to the case. As has been known for some time, this leakage is minimized by blade and sealing systems in which the blade tips rub against a seal attached to the interior of the engine case. Generally, the blade tip is made to be harder and more abrasive than the seal; thus, the blade tips will cut into the seal during those parts of engine operation when they come into contact with each other.

In the earlier systems of the type just described the blade tip was a superalloy material, possibly even having a hard face, and the seal was a metal which had a suitable propensity for wear. For instance, porous powder metals were used. Now however, ceramic containing seals are finding favor, such as those shown in U.S. Pat. No. 3,975,165 to Elbert et al, U.S. Pat. No. 4,269,903 to Klingman et al and U.S. Pat. No. 4,273,824 to McComas et al. The ceramic faced seals are considerably harder than the prior art metal seals and as a result, the prior art blade tips were deficient in being able to wear away the seal with little wear to themselves.

Consequently, there have been developed improved blade tips, most particularly of the type described in U.S. Pat. No. 4,249,913 to Johnson et al "Alumina Coated Silicon Carbide Abrasive" of common ownership herewith. In the Johnson et al invention silicon carbide particulate of 0.20–0.76 mm average nominal diameter is coated with a metal oxide such as alumina and incorporated by powder metal or casting techniques in nickel or cobalt base alloys. A powder metal compact containing 30–45 volume percent particulate may be made and this part is then bonded, such as by diffusion bonding, liquid phase bonding or brazing to the tip of a blade.

However, there are certain inherent characteristics of an abrasive tip made by the foregoing technique. Specifically, the metal part can only be made in a practical minimum thickness, typically of the order of 1–2 mm thick. Usually, the abrasive tip part is made in the cross sectional shape of the tip of the turbine blade substrate. After being compacted or cast it is machined to a flat surface. Likewise, the blade tip is machined to a planar surface to receive the abrasive. Such planar machining is a practical limitation necessary to get good faying fit and minimum weld joint thickness, of the order of 0.05 mm. Unless this is done adequate bond strength in the 1100° C. operating temperature range will not be attained. After bonding of the abrasive on a blade tip, a multiplicity of blades are assembled in a fixture which is adapted to rotate much like the disc of the engine in which they are used. They are then ground to a cylindrical or conical surface which corresponds with the interior surface of the engine case seals. As a result of this procedure, the abrasive will initially have a substantial thickness which will have to be ground to a substantial degree. The particulates are often costly and thus the approach is costly. Second, because practicality dictates a planar joint surface and because the final finished surface of the abrasive tipped blade will be cylindrical or conical, there will be a varying thickness of abrasive across the blade tip, as shown in FIG. 9 herein. While the prior art blade tips are useful, it is more desirable that the abrasive portion of the tip be uniform in thickness across the curved surface. It is also very desirable to minimize the quantity of grits which must be used in the manufacturing process since they must be of the highest quality and their manufacture, including the oxide coating process, is expensive.

An object of the present invention is to provide on the tip of the blade a thin and uniform layer of abrasive coating adapted for use in the vicinity of 1100° C. and higher. Thin layers of particulate bearing abrasive, although not adapted to operate at such high temperatures, have been known. For example, coated abrasives made from alumina, silica and silicon carbide are common products, as are metal bonded diamond and cubic boron nitride grinding wheels. Fused and unfused layers of sprayed metal are well known in the metallizing field. See for example U.S. Pat. No. 3,248,189 to Harris, Jr. and U.S. Pat. No. 4,386,112 of Eaton and Novak, the present applicants. However, any process of metal spraying grits and matrix metal is inherently inefficient in that only a fraction of the sprayed material actually hits and adheres to the surface. These difficulties are especially significant in light of the relatively small size, e.g., about 6 by 50 mm, of a typical turbine blade tip.

Of particular interest in the context of the present invention is the following art. Silicon carbide particles are bonded to a fabric using an organic binder and then overcoated with aluminum, and other metals, according to Fontanella U.S. Pat. No. 3,508,890 and Duke et al U.S. Pat. No. 3,377,264. Fisk et al in U.S. Pat. No. 3,779,726 describe a method of making metal-abrasive tools containing silicon carbide and other grits which comprises encapsulating grit in a porous metal coating and then impregnating the encapsulating layer with other metal to unite the particles. Palena in U.S. Pat. No. 4,029,852 describes how a non-skid surface is made by laying grits on a surface and spraying molten metal droplets over them. The Palena invention involves a relatively crude product, such as a stairway tread, in contrast to the finer product which characterizes metal bonded abrasives and the invention herein. Wilder in U.S. Pat. No. 3,871,840 describes how encapsulating grits in a pure metal envelope improves the properties of a metal bonded abrasive made in various ways.

When an abrasive is used on a superalloy turbine blade tip, its method of application must be metallurgically compatible with obtaining or maintaining the desired properties of the superalloy substrate. Since turbine blade superalloys reflect a highly refined metallurgical art there are real limits on cycles associated with abrasive tip formation. The abrasive is not a structural material and its weight imposes stresses on the blade substrate during use wherein the blade rotates at high speed. Thus it is highly desirable that the minimum thickness abrasive be applied. But since blades are finished to length tolerances of 0.05 mm or less this means both the preparation of the substrate and the application of an abrasive layer must be carried out with high precision. All these considerations place severe restraints on the kinds of material and processing which are useful and considerable research and development has gone into the making of the present invention.

DISCLOSURE OF THE IVENTION

An object of the invention is to provide on the surface of an article an abrasive material comprised of uniformly spaced apart particulate in a single layer, which particulate is evenly spaced and securely bonded to the substrate. Another object of the invention is to provide on the tip of a gas turbine blade a high temperature abrasive which is resistive to oxidation and thermal fatigue failures.

In the invention an abrasive material comprised of particulates and matrix is provided on the surface of an article by a series of interrelated steps. First, ceramic particles, such as alumina coated silicon carbide, are metallically adhered to the surface to hold them in place during the subsequent step. This is best achieved by cladding the ceramic particulate with a metal such as nickel, laying the particulates on the surface of the substrate and securing them there with a volatile organic adhesive, and then heating under an inert atmosphere to sinter bond the cladding to the substrate. Next, a matrix alloy material is deposited on the surface to cover the particulates and to fill the spaces between the particulates. Characteristically, the processes which deposit complex matrix alloys are "line of sight" processes, i.e., those in which the metal travels from a source in a straight line. These processes characteristically will leave voids immediately adjacent to irregular ceramic particulates. Plasma arc spraying at subatmospheric pressure on an elevated temperature superalloy substrate is preferred for depositing superalloy matrices. The matrix is then simultaneously heated and pressed, preferably by hot isostatic pressing. This eliminates the voids and securely bonds the matrix to the substrate and, by interdiffusion, to the cladding on the particle.

The abrasive may then be machined to form a finished surface wherein all the particles are exposed or made visible. When the abrasive is used on the tip of a gas turbine engine blade, part of the matrix is then chemically removed, to decrease the matrix thickness and thereby cause portions of the particulates to project into space. Usually 10–50% of the matrix thickness is removed, since so freeing the particulates makes more favorable the interaction of an abrasive with a ceramic abradable seal.

The particulates are particularly sized with respect to the matrix layer of thickness. Control over the sizing and aspect ratio are necessary to insure that the preponderance (80% or more) of the particles both extend to the free surface of the abrasive and are fully surrounded by matrix material in the plane which is parallel to the surface of the article. The ceramic particulates initially deposited have a nominal dimension greater than the finished thickness of the abrasive. Thus, particulates sized between Nos. 35–40 U.S. Sieve Series (0.42–0.50 mm nominal openings) are used when the abrasive thickness is 0.38 mm. The particulates are desirably spaced apart on a regular pattern of 33–62 particulates per $cm^2$ of substrate surface. This relatively close spacing necessitates using particles with aspect ratios less than 1.9 to 1, so that less than 15% of the particulates will contact one another after they are metallically adhered on the surface.

The invention is especially useful in applying a uniform thickness layer of abrasive to a curved tip of varying cross section, such as the tip of a gas turbine blade. It is economical in the use of the materials and produces good tip durability when interacting with ceramic seals.

The foregoing and other objects, features and advantages of the present invention will become more apparent from the following description of preferred embodiments and accompanying drawings.

BRIEF DESCRIPTION OF DRAWINGS

FIGS. 1–4 show schematically the sequential steps by which particulates are placed on the surface of a substrate, enveloped in matrix, machined to a flat surface, and machined to a final configuration.

FIG. 5 is a more detailed view of a portion of FIG. 1 showing how particulates appear after they have been metallically adhered to the surface of the substrate.

FIG. 6 is a more detailed view of a portion of FIG. 2 showing how the matrix envelops particulates and includes porosity when a "line of sight" deposition procedure is used.

FIG. 7 is a more detailed view of a portion of FIG. 2 showing how the structure in FIG. 6 is transformed after high temperature pressing to eliminate voids and cause interdiffusion.

FIG. 8 shows generally a typical gas turbine blade having an abrasive layer on its tip.

FIG. 9 shows in side view the appearance of a prior art abrasive blade tip, illustrating the varying thickness and bond joint.

FIG. 10 is a side view of the blade in FIG. 8, along line D, showing how particulates are present in a single layer and how they extend slightly above the matrix material of the abrasive.

BEST MODE FOR CARRYING OUT THE INVENTION

In an example of the practice of the invention an abrasive 30 is formed on the tip 28 of the airfoil part 24 of a gas turbine blade 20, as shown in FIG. 8. The blade is made of a nickel superalloy (such as the single crystal alloy of U.S. Pat. No. 4,209,348) and while the abrasive material (or simply the "abrasive") is comprised of a nickel base superalloy matrix and alumina coated silicon carbide particulates, generally in accord with the materials referred to in the Johnson et al patent referred to in the Background. The disclosures of the foregoing patents are hereby incorporated by reference. As will be evident, other materials may be used in the practice of the invention.

When an inventive abrasive is formed on the tip of a gas turbine blade it is subjected to very high use stresses and therefore it is important that the abrasive have a certain configuration and properties to perform its function. In particular, the particulates must be disposed on the tip in a certain manner to obtain optimum performance.

In the prior art shown by FIG. 9 there are several random layers of particulates 33*a* within the matrix metal 35*a*. A bond joint 31 held the abrasive on the planar tip surface 32*a* of the blade tip 28*a*. The free surface 30*a* of the abrasive is curved; the thickness varies and there tends to be a lack of particulate at the edges. In the invention as shown in FIGS. 8 and 10 the blade has a radius R and the abrasive surface 30, as measured along the mean camber line C is curved since the tip conforms to the circumference D. The blade tip surface 32 is also curved. There is a single layer of particulates in the abrasive which is of generally uniform thickness. This minimizes the amount of abrasive material mass, thus reducing the centripetal force on the blade. The matrix metal has a thickness W less than the overall thickness of the abrasive 26, to thus expose the particulates at the free surface and to enable better interaction with ceramic abradable seals. Experience has also shown that the particulates must be fully surrounded by matrix metal, so that they are adequately bonded to the matrix, and to adequately bond the abrasive to the substrate of the blade tip article. Perfection is not always attained, but in the invention at least 80–90% of the particulates (excluding those at the exposed edges of the tip) are surrounded by matrix metal rather than being in contact with another particulate. Thus the invention requires that the particulates be evenly but densely spaced on the surface. Densities of 33–62 particulates per $cm^2$ of tip surface are obtained, with greater than 42 particulates per $cm^2$ being preferred.

The abrasive is preferably about 0.38 mm thick as measured to the finished surface 30, 44 of the particulates and the matrix thickness W is about 50–90 percent of this thickness. For the particulates to extend fully from the substrate surface to the free surface, they must be of a certain size, i.e., nominally 0.38 mm or greater. In fact, particulates of No. 35–40 U.S. Sieve Series Size (nominally 0.42–0.50 mm) have been found useful; up to U.S. No. 20 (0.83 mm) size also appears useful. With the normal variation in size distribution that results from sieving at least 80–90 percent of the particulates will extend through the matrix.

FIG. 1 shows in side view how the particulates 33 are first laid on the surface 32 of the substrate 28 where they will be subsequently permanently adhered. Prior to placing the silicon carbide particulates on the surface, they have had applied to their exteriors a coating of 0.010 mm vapor deposited alumina according to the Johnson et al patent, and a cladding of metal, such as vapor deposited nickel to a thickness of 0.002–0.050 mm. Procedures for applying nickel coatings to ceramic particulates are commercially available and also are revealed in U.S. Pat. Nos. 3,920,410, 4,291,089 and 4,374,173. If the ceramic particulate material is inherently resistant to reaction with the matrix then the alumina coating would not be necessary.

Just before the particulates are laid on the surface of the blade tip, a coating of polymer adhesive which can be later vaporized at less than 540° C. is applied to the surface, to hold the particulates in place after they are deposited. We prefer 1–20 volume percent polystyrene in toluene. The particulates are laid on the surface by first attracting them to a perforated plate to which a vacuum is applied, and then positioning the plate over the surface and releasing the vacuum momentarily. It will be evident that other techniques and adhesives may be used to place the particulate.

Next the blade with the organically bonded particulates is heated while in a vertical position to a temperature of at least 1000° C., typically about 1080° C. for 2 hours, in a vacuum of about 0.06 Pa using a heat-up rate of about 500° C. per hour. Other inert atmospheres may be used. This step first volatilizes the polystyrene adhesive and then causes solid state bonding or sintering of the nickel cladding to the surface of the blade. The nature and location of the bond joint 34 as it is metallographically observable upon removal from the furnace is shown in FIG. 5. Owing to the irregular shape of the particulates and the thinness of the metallic cladding on the particulates, the bond 34 is relatively delicate and located only at the points where particles 33 are very close to the surface 32. As will be appreciated, when the matrix is a superalloy it is not desirable to have a great deal of bond metal either around the particulate or bonding it to the substrate of the blade. It is also undesirable to expose the substrate to a temperature higher than about 1080° C. and therefore, the choice of cladding on the particulates is limited to materials which will produce a bond at such conditions. Furthermore, the cladding material must be one which is compatible with and tends to interact with both the substrate and the subsequently applied matrix material. These limitations nonetheless allow for a variety of materials to be used. Preferably, nickel, cobalt or mixtures thereof are used. Alloying additions which are known to promote bonding may be also included. Generally, the basis metals of the cladding will tend to be those from the transition series of the periodic table when nickel, cobalt or iron base matrix and substrate alloys are involved. Under certain circumstances a coating may be applied to the surface 32 to enhance the desired adhesion.

Next, the particulates are oversprayed with a layer of matrix material deposited by plasma arc spraying to a thickness T of about 1.1–1.3 mm as shown in FIGS. 2 and 6. A nickel base superalloy as described generally above is used, such as that having the composition by weight percent 25 Cr, 8 W, 4 Ta, 6 Al, 1.0 Hf, 0.1 Y, 0.23 C, balance Ni.

The −400 U.S. Sieve Series Mesh powder is applied by argon-helium plasma arc spraying in a low pressure chamber. For example, commercially available equipment such as a 120 kw low pressure plasma arc spray system of Electro-Plasma Inc. (Irving, Calif., USA) may be used. See also U.S. Pat. No. 4,236,059. A blade is placed in the spray chamber which is evacuated to a pressure of 26 kPa or less. The oxygen level in the atmosphere is reduced to a level of 5 ppm by volume or less, such as by contacting the atmosphere in the chamber with a reactive metal. The workpiece blade is positioned with respect to the plasma arc device so that the tip cross section to be sprayed is normal to the axis along which the molten particulates travel. The blade is suitably masked around its periphery so that errant spray does not deposit on the sides of the blade.

Prior to initiating the actual deposition, the workpiece is simultaneously heated by the hot plasma arc gas to an elevated temperature of at least 700° C., typically 925° C., while being made cathodic with respect to a ground electrode located near to or as an integral part of the plasma arc device. A current of about 70 amperes is applied to a typical turbine blade tip for a period of about 2–10 minutes to aid in removing any oxide layers which may have accumulated on the part. The purpose of the heating process is to increase the receptivity of the part to the plasma arc spray and improve the bonding, as well as to decrease the residual stresses which are present after the workpiece, including the matrix metal and substrate has cooled to room temperature. The preheating thus reduces thermal strain which is present between the abrasive material and the substrate at the operating or use temperature of the part, which for a turbine blade tip tends to be in the range of 750–1100° C. The abrasive will thus be made more resistive to cracking or spalling failure.

The metal matrix is applied to a thickness of 0.6–1.3 mm, preferably 1.1–1.3 mm as indicated. Preferably, the matrix material is deposited by a physical process in a thickness and quality such that the layer of metal is impenetrable to argon gas at elevated pressure, e.g., at least 130 MPa, typically 138 MPa, for the preferred matrix. This impermeability is attainable with the above described plasma spray process, provided sufficient thickness is applied. Although the layer will have about 95 percent theoretical density, it will nonetheless be characterized by some porosity as shown in FIG. 6. In particular, porosity 38 is present in the material above the surface of the particulates and there are voids 40 adjacent many of the particulates. The voids 40 are characteristic of the metal spraying process and would be produced by any "line of sight" deposition process, or one in which the deposited material physically travels in a straight line. Such voids may not be expected from electroplating process, chemical vapor deposition, etc. The reason that metal spraying is used is because it is one of the few processes capable of applying a superalloy, with all its diverse constituents. Another process that may be used is a physical vapor deposition process, since such process has been shown to be capable of applying MCrAlY coatings and the like. See U.S. Pat. No. 4,153,005 to Norton et al.

Next, after the part has cooled within the vacuum chamber it is removed and subjected to a hot isostatic pressing procedure. Generally, this comprises deforming the abrasive material beyond its yield or creep-limit point at elevated temperature. Preferably, the part is subjected to argon pressure while at elevated temperature, to close the aforementioned pores and voids. For the specific superalloy matrix material described above, a temperature of 1100° C. and a gas pressure of 138 MPa applied for two hours is sufficient. Other hot pressing procedures may be used to consolidate the matrix and achieve the object of densification and bonding. After the matrix is consolidated, the part is cooled in the furnace and removed.

The consolidated abrasive surface coating at this stage physically still appears as shown schematically in FIG. 2 except that the matrix has been compressed somewhat. But FIG. 7 shows in more detail how it appears in a metallographically prepared specimen. The superalloy matrix 36 is dense and fully envelops the particulates; and, there is a region 42 surrounding each particulate 33, which region is deficient in chromium and aluminum, and rich in nickel, compared to the composition of the matrix material. This is of course a result of the nickel cladding layer which was applied to the particulate and as such it is a characteristic of the invention, although it is not particularly advantageous in the end product.

Next, the rough surface of the abrasive shown in FIG. 2 is machined using a conventional procedure such as grinding to produce the shape shown schematically in FIG. 3. The free surface 44 provides the desired z length dimension T′ which will characterize the finished blade. Next, the surface 44 of the blade is contacted with an etchant or other substance which will attack the matrix material, to thereby remove a portion of it. For example, electrochemical machining can be used, as is described in U.S. patent application Ser. No. 517,315 of Joslin, filed July 26, 1983. This step reduces the matrix z axis thickness to a dimension W; which dimension is 50–90 percent of the dimension T′, and results in the shape schematically shown in FIG. 4 (and more realistically, in that the surface 44 is curved, in FIG. 10).

Some further aspects of the invention warrant discussion. With respect to the cladding which is applied to particulates, its function thereof is to hold the particulates in place during the plasma arc spraying or other deposition process. Such holding is necessary so the particulates do not blow away under the forces associated with plasma arc spraying. But even if such forces are minimized or absent when another process is used, particles can be lost during handling. (In fact, even in the invention the delicate nature of the bonds results in the loss of a certain number of particles.) Silicon carbide is subject to attack by nickel but the alumina coating is not. The nickel cladding is physically applied and bonding is obtained below the melting point of the cladding. This is the preferred practice and cladding of the particulates is the easiest way to ensure that each particulate will be bonded to the surface. However, substitutional measures may be used, such as by providing on the surface of the article a metallic material which has an affinity to the particulate material, and forming a bond by a time-temperature exposure, when the combination of materials and intended use permits. Also, laying the particles on the surface and electroplating lightly over them may be contemplated.

It has been found that there is a criticality in the aspect ratio of the particulates, relevant to the obtaining of a uniform density and a lack of agglomeration or inter-particulate contact. When the particulates are long and thin, they will of course tend to lie on their sides either when laid on the surface initially or in the interval between the volatilization of the organic bonding agent and the attainment of a metallic bond. Such laying-at-length disrupts the uniformity of placement and causes undue interparticle contact. Thus, it has been discovered that the invention is best practiced when the aspect ratio of the particulates is less than 1.9 to 1 and preferably is about 1.5 to 1 or less. The aspect ratio is defined herein as the average ratio of the longest particle dimension to the cross sectional dimension, as such is measured on a Quantimet Surface Analyzer (Cambridge Instruments, Cambridge, England).

The present invention is especially useful in providing a more effective abrasive when the matrix is chemically milled away partially, compared to the prior art. Suppose abrasive materials having the same volume percent identically sized and shaped particulate are made, first using the invention and second, according to the prior art powder metal technique, as represented in FIG. 9. The area of ceramic appearing on the initial ground surface of a matrix and particulate abrasive will be identical. But with the present invention's two dimensional structure the ceramic areas will be generally uniform since the particulates are arranged along the surface as a layer. And when the matrix is partially removed by chemical milling the same amount of ceramic cutting material will remain at the original free surface; the particulates will all be about equally well-bonded. In contrast, while the prior art abrasive as initially machined will have the same total area of ceramic, owing to the three-dimensional structure, a greater number of particulates will be exposed and they will have varying areas, from zero up to the nominal maximum. Some will be barely touched and others will be practically fully machined away. When the matrix is chemical milled, those which were mostly contained in the matrix which is removed will of course be lost. The net result is that there will be less area of abrasive remaining at the free surface and the abrasive will be less effective.

Although this invention has been shown and described with respect to a preferred embodiment, it will be understood by those skilled in the art that various changes in form and detail thereof may be made without departing from the spirit and scope of the claimed invention.

We claim:

1. The method of providing an abrasive material comprised of particulates and matrix on the surface of an article characterized by adhering a single layer of spaced apart ceramic particulates having a metal cladding to the article surface; causing the metal cladding to adhere to the surface so that the particulates are thereby adhered to the article and project from the surface in spaced apart fashion; depositing on the surface a layer of metal to fill the spaces between the particulates with matrix material which inherently has voids; heating the article to an elevated temperature to densify the matrix and to metallurgically bond the matrix to the metal clad particulates and the substrate; and machining the surface of the abrasive material to a finish surface so that the particulates are visible at the surface.

2. The method of providing an abrasive material comprised of particulates and matrix on the surface of an article characterized by metallically adhering a single layer of metal clad ceramic particulates to the article surface so that the particulates are spaced apart and project from the surface; plasma arc spraying on the surface a layer of metal to fill space between the particulates with matrix material wherein the article surface is heated to at least 700° C. before and during plasma arc spraying at a subatmospheric pressure, to form an impermeable matrix layer; and then, hot isostatic pressing the matrix layer to densify and bond the layer to the particulate and substrate.

3. The method of claim 1 characterized by depositing the layer of metal using a line-of-sight deposition process.

4. The method of claim 3 characterized by using plasma arc spraying for depositing.

5. The method of claim 1 characterized by sizing the ceramic particulates to predominantly have a nominal dimension greater than the thickness to which the abrasive material is machined.

6. The method of claim 2 characterized by using argon gas hot isostatic pressing to generate a temperature of at least 1100° C. and a pressure of at least 130 MPa, to which pressure said matrix is essentially impenetrable when deposited.

7. The method of claim 1 characterized by adhering particulates which are sized between No. 20 and 40 U.S. Sieve Series to the surface with a density of 33–62 particulates per $cm^2$ of substrate surface.

8. The method of claim 1 characterized by sizing and spacing the particulates so that less than 15 percent are contacting one another when they are metallically adhered on the surface.

9. The method of claim 1 characterized by removing a portion of the matrix layer after machining of the abrasive to decrease its thickness and to thereby free the portions of the particulates which extend to the machined abrasive material surface of surrounding matrix.

10. The method of claim 9 wherein 10–50 percent of the matrix thickness is removed.

11. The method of claim 1 characterized by bonding the metal clad ceramic particulate to the substrate surface with an organic adhesive to position it prior to metallically adhering it to the surface, and then removing the adhesive during the adhering step.

12. The method of claim 1 wherein the article is a gas turbine superalloy blade and the abrasive material is formed on a curved tip surface, characterized by machining the abrasive material surface so the abrasive material has a uniform thickness.

13. The method of claim 1 wherein the metallic adhering is achieved by sintering at an elevated temperature in an inert atmosphere which avoids oxidation of the metal which clads the particulate.

14. The method of claim 1 characterized by depositing particulates having an aspect ratio of less than 1.9 to 1.

15. The method of claim 14 characterized by particulates having an aspect ratio of about 1.5 to 1 or less.

* * * * *